US006179574B1

(12) United States Patent
Yie

(10) Patent No.: US 6,179,574 B1
(45) Date of Patent: Jan. 30, 2001

(54) APPARATUS FOR PRESSURIZING FLUIDS AND USING THEM TO PERFORM WORK

(75) Inventor: Gene G. Yie, Auburn, WA (US)

(73) Assignee: Jetec Company, Auburn, WA (US)

( * ) Notice: Under 35 U.S.C. 154(b), the term of this patent shall be extended for 0 days.

(21) Appl. No.: 09/153,274

(22) Filed: Sep. 14, 1998

Related U.S. Application Data

(63) Continuation-in-part of application No. 08/787,089, filed on Jan. 22, 1997.

(51) Int. Cl.[7] ..... F04B 27/08

(52) U.S. Cl. ..... 417/269; 417/270; 417/225; 417/493; 417/498; 91/499; 92/71

(58) Field of Search ..... 417/269, 270, 417/225, 493, 498; 91/499; 92/71

(56) References Cited

U.S. PATENT DOCUMENTS

| | | | | |
|---|---|---|---|---|
| 1,763,154 | * | 6/1930 | Holzwarth | 137/624.13 X |
| 2,100,154 | * | 11/1937 | Ashton | 137/624.13 |
| 2,398,542 | * | 4/1946 | Light | 137/624.13 X |
| 2,477,590 | * | 8/1949 | Ferwerda | 137/624.13 X |
| 2,677,326 | * | 5/1954 | Schindle | 417/26 |
| 2,818,881 | * | 1/1958 | Bonner et al. | 137/624.13 X |
| 2,970,571 | * | 2/1961 | Pecchenino | 137/624.13 X |
| 3,348,495 | * | 10/1967 | Orshansky, Jr. | 417/269 |
| 3,679,328 | * | 7/1972 | Cattanach | 417/270 |
| 3,861,829 | * | 1/1975 | Roberts et al. | 417/53 |
| 4,277,229 | * | 7/1981 | Pacht | 417/539 X |
| 4,534,427 | | 8/1985 | Wang et al. . | |
| 4,551,077 | * | 11/1985 | Pacht | 417/539 X |
| 4,555,872 | | 12/1985 | Yie . | |
| 4,611,973 | * | 9/1986 | Birdwell | 417/347 X |
| 4,621,988 | * | 11/1986 | Decker | 417/347 X |
| 4,776,260 | | 10/1988 | Vincze . | |
| 5,022,310 | * | 6/1991 | Stewart et al. | 91/501 |
| 5,092,362 | | 3/1992 | Yie . | |
| 5,117,872 | | 6/1992 | Yie . | |
| 5,167,181 | * | 12/1992 | Lee | 91/499 |
| 5,186,393 | | 2/1993 | Yie . | |
| 5,241,986 | | 9/1993 | Yie . | |
| 5,297,777 | | 3/1994 | Yie . | |
| 5,524,821 | | 6/1996 | Yei et al. . | |
| 5,733,105 | * | 3/1998 | Beckett et al. | 417/269 |

FOREIGN PATENT DOCUMENTS

| | | | | |
|---|---|---|---|---|
| 3413867 | * | 10/1984 | (DE) | F04B/1/10 |

* cited by examiner

*Primary Examiner*—Teresa Walberg
*Assistant Examiner*—Jeffrey Pwu
(74) *Attorney, Agent, or Firm*—Pauley Petersen Kinne & Fejer

(57) ABSTRACT

A fluid transfer apparatus utilizing a slanted cain disk to oscillate and rotate a set of pistons arranged in a circle. Channels associated with the pistons and piston housing effect the transfer of fluid from a first location to a second location, as well as the pressurization or depressurization of the fluid, during movement of the pistons. The apparatus can be used as a high-pressure fluid pump, a fluid-powered motor, a fluid distribution valve, or another fluid transfer device.

25 Claims, 7 Drawing Sheets

APPARATUS FOR PRESSURIZING FLUIDS AND USING THEM TO PERFORM WORK

RELATED APPLICATIONS

This application is a continuation-in-part of U.S. patent application Ser. No. 08/787,089, filed Jan. 22, 1997, the disclosure of which is incorporated by reference.

FIELD OF THE INVENTION

This invention is directed to a fluid transfer apparatus for handling high pressure fluids, and different uses. The fluid transfer apparatus may be incorporated into a fluid pump, a fluid-driven motor, a fluid distribution valve, or another device.

BACKGROUND OF THE INVENTION

Axial piston pumps useful for hydraulic applications are well known in the art. These pumps are characterized by the presence of multiple pistons positioned axially with respect to each other. The axially-positioned pistons oscillate linearly in conjunction with sets of check valves, to pressurize fluid. In one family of axial piston pumps, the oscillating pistons are situated in a rotating drum and are in contact with a swash plate or wobbler disk that has a slanted face for imparting sliding piston motions. The check valves are generally in the form of a stationary disk having slots to serve as in-out fluid passages. In another family of axial-piston pumps, the multiple pistons are situated in a stationary cylinder while a rotating cam disk having a slanted face is in contact with the pistons to impart oscillating motions. In both cases, return springs are generally used to provide the piston return forces.

In rotating-cam pumps, separate inlet and outlet check valves in the form of balls and poppets are often used. U.S. Pat. No. 3,348,495 issued to Orshansky teaches a dual-cam axial-piston pump of this type. The outlet check valve of this type of pump is easy to manage, requiring a simple one-way valve at the bottom of each piston cavity. The inlet check valve of this family of pumps, on the other hand, is more difficult to configure. Orshansky discloses the use of another set of pistons purely for the valving purpose.

U.S. Pat. No. 4,776,260, issued to Vincze, discloses a cam-driven axial piston pump which utilizes ball check valves at the inlet and outlet of each piston cavity. A six-piston pump of this design, for instance, has six inlet ball check valves and six outlet ball check valves.

In any pump, the design of the check valves is an integral part of the pump design. A pump cannot function without good check valves. The reverse process of converting linear oscillatory motion of multiple, axially positioned pistons to the rotatory motion of a shaft is also very common. This is the essence of fluid-powered motors. In such motors, the potential energy stored in pressurized fluids is released by pushing a set of axially-positioned pistons to rotate a shaft through a cam disk having a slanted face. In some cases, the device capable of generating shaft power is also a pump. Orshansky teaches an axial-piston pump that can function as a motor simply by reversing the role of the fluid. The pump disclosed in Vincze is not reversible, and cannot function as a motor due to the check valves involved.

Reversible pump-motor devices are rather rare and their capability is not even in the two different functions. There are many other fluid-powered motors that are simpler and less expensive than axial-piston motors. Therefore, axial-piston motors must possess unique capabilities in order to be viable in the marketplace. This is also true for axial-piston pumps.

SUMMARY OF THE INVENTION

This invention is directed to a fluid transfer apparatus for handling high pressure fluids, and various uses of the apparatus. The apparatus can be used as a pump, a fluid powered motor, a fluid distribution device, or another fluid transfer device.

The apparatus of the invention may transfer rotational motion of a shaft, to oscillatory motion of pistons or plungers affecting process fluids such as oil, water, gases, and other liquids. In this case, the invention accomplishes the pressurization of fluids so that kinetic energy input is converted to potential energy stored in a fluid.

The apparatus of the invention may also perform the reverse, by transferring the oscillatory motion of pistons or plungers to the rotational motion of a shaft. In this case, the invention uses pressurized fluids to drive the pistons. In other words, potential energy stored in a fluid is converted to kinetic energy.

The fluid transfer apparatus includes a device for transmitting torque, a rotary device associated with the device for transmitting torque, a plurality of oscillating pistons engaging the rotary device, a housing for the pistons, and channels associated with the pistons and housing for effecting the transfer of fluid from a first location to a second location as the pistons oscillate. The apparatus also includes an oscillator which ensures that the pistons will oscillate with a phase shift between them.

The fluid transfer apparatus of the invention employs a combination of linear and rotary motions to drive the set of multiple pistons or plungers. The multiple pistons or plungers may oscillate axially, but in a rotating sequence, at a prescribed oscillating frequency and rotational speed. The rotational sequence may be obtained by arranging the pistons in a circular fashion, at equal distances. Then, the pistons can be axially oscillated at the same frequency, but with a constant phase shift between adjacent circumferentially-spaced pistons.

The channels associated with the pistons and surrounding housing effect the transfer of fluid from the first location to the second location. The channels are arranged, and the motion of the pistons is synchronized, lo effect a substantially continuous fluid transfer accompanied by a pressurization or depressurization of fluid.

With the foregoing in mind, one feature and advantage of this invention is to provide a unique pump for raising the pressure of fluids such as gas or liquids by converting the shaft power of an engine or motor to the stored potential energy of a pressurized fluid.

Another feature and advantage of this invention is to provide a unique fluid-powered motor that is capable of converting the potential energy contained in a pressurized liquid or compressed gas to kinetic energy in the form of shaft power.

A furer feature and advantage of this invention is to utilize this unique energy-conservation process to perform various useful work, such as distribution of fluid flow and fluid pressure intensification.

The foregoing and other features and advantage of the invention will become further apparent from the following detailed description of the presently preferred embodiments, read in conjunction with the accompanying drawings. The detailed description and drawings are merely illustrative rather than limiting, the scope of the invention being defined by the appended claims and equivalents thereof.

BRIEF DESCRIPTION OF THE DRAWINGS

FIG. 5(*b*) is a schematic view showing the piston arrangement in the device of FIG. 5(*a*);

DETAILED DESCRIPTION OF THE PRESENTLY PREFERRED EMBODIMENTS

This invention is an apparatus for converting a rotary motion of a shaft to rotating oscillatory motion of multiple pistons, and vice versa. In a preferred embodiment, the invention uses one or more circular cam disks having sloped face to mate with a group of three or more axially positioned pistons or plungers. These pistons have exactly the same sloped mating face in contact with the cam disks such that the rotation of the cam disk produces an oscillatory rotation on the pistons, and vice versa. This oscillatory rotation motion of the pistons is then advantageously utilized to construct integrated check valves such that a unique fluid pump, fluid-powered motor, and other useful devices are produced.

Figure 1:
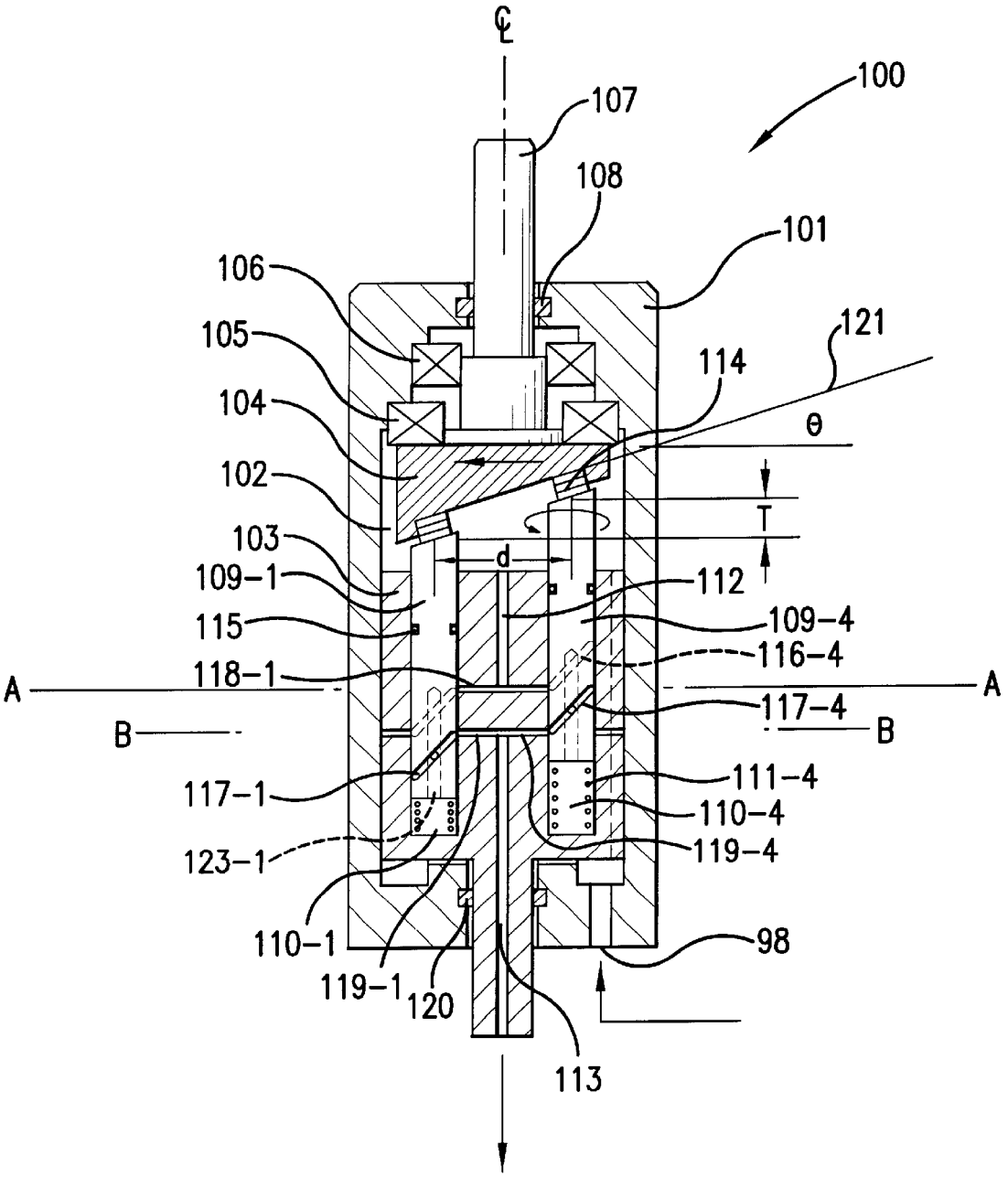
FIG. 1 is a sectional view of a fluid transfer apparatus of the invention.
Figure 2A:
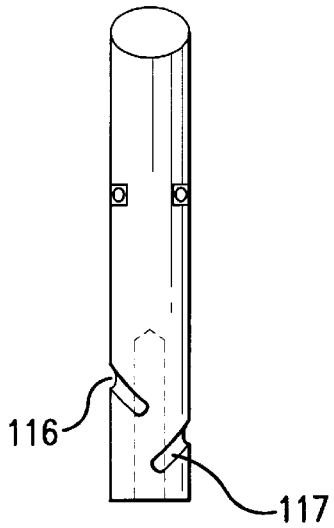
FIG. 2 illustrates sectional views of a piston used in the fluid transfer apparatus, in three different rotational positions.
Figure 2B:
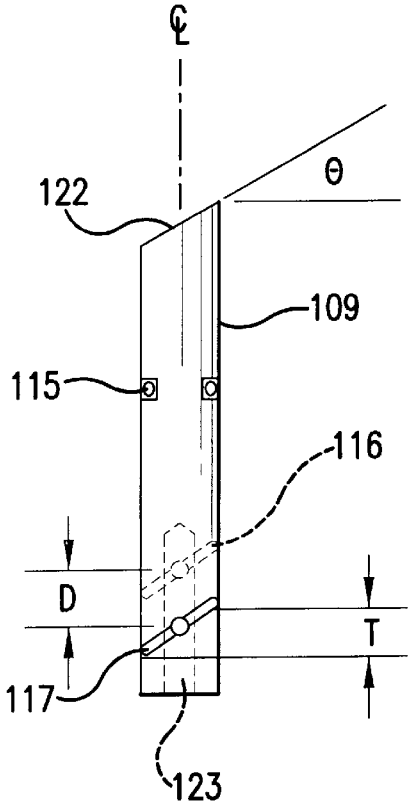
Figure 2C:
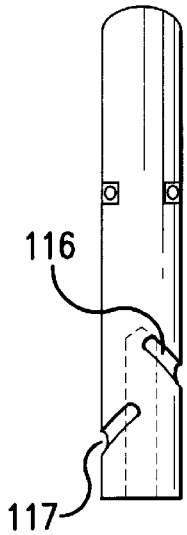
Figure 3A:
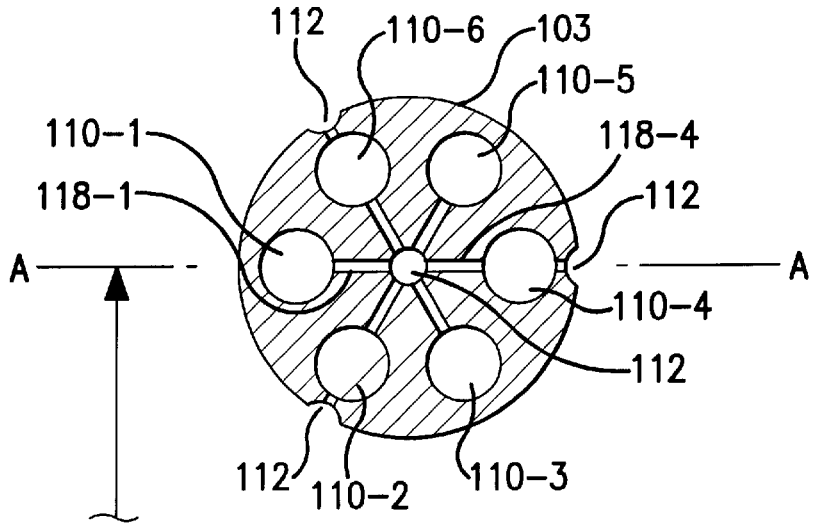
FIG. 3 includes a schematic view taken along line A—A in FIG. 1, and a schematic view taken along line B—B in FIG. 1, showing the arrangements of pistons and channels.
Figure 3B:
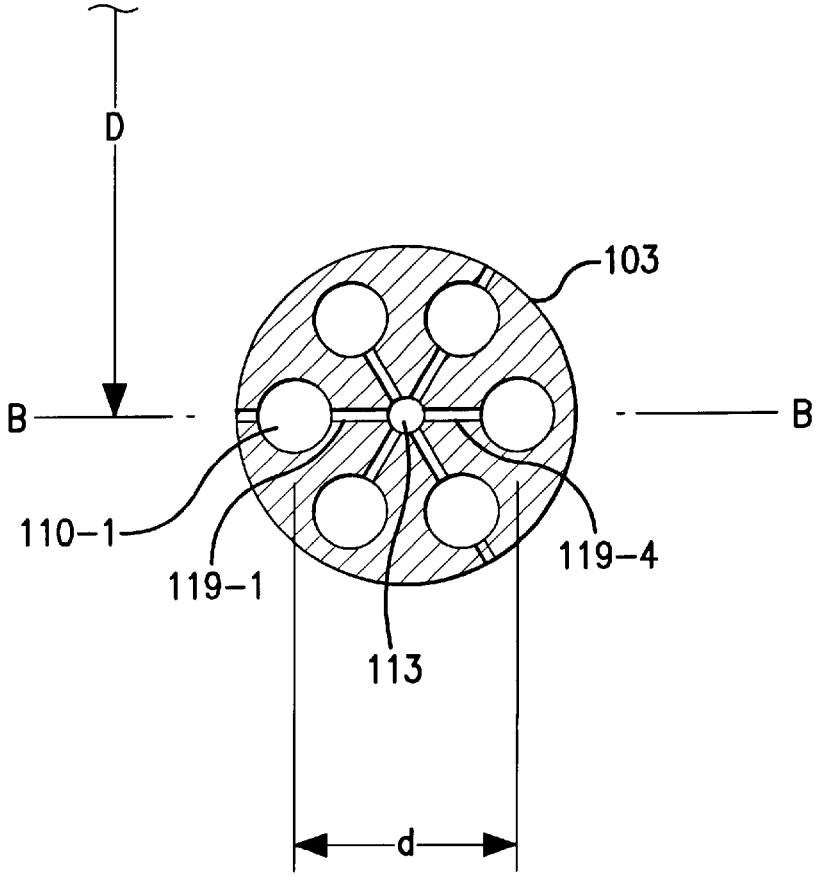

FIGS. 1–3 illustrate an embodiment of the fluid transfer apparatus which is useful as a high pressure fluid pump. The fluid transfer apparatus 100 includes a pump casing or housing 101, which can be constructed from multiple sections bolted or otherwise fastened together. The casing 101 defines an interior chamber 102, which can be cylindrical, and which houses the inner workings of the apparatus 100.

The fluid transfer apparatus 100 includes a device for transmitting torque. In FIG. 1, the torque device includes an elongated shaft 107 extending through an opening at the top of housing 101. One end of shaft 107 may be engaged to a motor (not shown) outside the housing 101. The shaft 107 receives torque from the motor, and transmits it to a rotary device, which can be cam disk 104 positioned inside the housing 101, and engaged to the other end of shaft 107. A shaft seal 108 located between shaft 107 and housing 101 prevents lubricating oil from leaking from the chamber 102 as the shaft 107 is rotated.

The cam disk 104 is supported, centered and held in place by a thrust bearing 105 and radial bearing 106, both of which are located above the cam disk 104 and adjacent the housing 101. The cam disk 104 preferably has a generally cylindrical cross section and an upper face firmly connected to the shaft 107. As the shaft 107 turns, the torque is thus transmitted from the motor to the cam disk 104, causing cam disk 104 to rotate. The rotation may be clockwise or counterclockwise. The cam disk 104 has a lower face 121 which is slanted at an angle θ relative to a plane perpendicular to the longitudinal axis of housing 101. As shown below, the preferred angle θ may vary with the diameter of a circle defined by the piston arrangement. Generally, the angleθ will be from about 10–50°, commonly about 15–45°, desirably about 20–40°.

Located below the cam disk 104 is a piston housing or cage 103, containing a plurality of cylindrical pistons 109 arranged in a circular pattern as shown in FIG. 3. Each piston 109 is positioned in a separate cavity or bore 110 inside the piston cage 103. The lower end of each piston 109 is flat, and engages a biasing mechanism. The biasing mechanism, which can be a spring 111 located inside the piston cavity 110, urges the corresponding piston 109 upward in the cavity, and against the slanted lower face 121 of the cam disk 104. The upper end of each piston 109 includes a slanted surface 122, which is complementary to the slanted surface 121, having an angle θ, on the underside of cam disk 104. A thrust bearing 114 may be positioned between the slanted surfaces 121 and 122, t o alleviate friction between the surface s as the cam disk 104 rotates. A static seal 120 prevents fluid leakage between the piston cage 103 and outer housing 101.

Due to the slanting of its lower surface 121, the rotting of the cam disk 104 causes the pistons 109 to oscillate axially in the individual cavities 110, against the biasing forces of springs 111. The oscillation of pistons 109 occurs at a regular frequency corresponding to the rotational speed of cam disk 104. Assuming the pistons are positioned in a circular pattern with equal spacing between them, as shown in FIG. 3, the oscillation of adjacent pistons will occur in a rotational sequence, with a constant phase shift between them. For instance, if six pistons 109 are used, as shown in FIG. 3, the oscillation of each piston will occur a 60° phase difference relative to each adjacent piston. As shown in FIG. 1, piston seals 115 may be used between each piston 109 and cavity 110, to prevent leakage of lubricating oil from chamber 102 during oscillation of the pistons.

As can be appreciated from FIGS. 1 and 2, the rotation of the cam disk 104, and the slidable engagement between the slanted surface 121 of cam disk 104 and complementary slanted surfaces 122 of pistons 109, causes a corresponding rotation of pistons 109 during their oscillation in the cavities 110. In FIG. 2, left diagram piston 109 is shown with the slanted surface facing out of the paper. When the cam disk 104 is rotated 90° clockwise, to the position shown in FIG. 1, each piston 109 rotates 90° to the positions shown in FIG. 1 and in FIG. 2, middle diagram. When the cam disk 104 is rotated another 90°, each piston 109 rotates another 90° to the position shown in FIG. 2, right diagram.

The linear distance traveled by a piston 109 during oscillation is a function of the angle θ of slanted surface 121 and the diameter "d" of the circle in which the pistons 109 are arranged. This linear travel distance "T" is represented by the following equations:

$$\tan\theta = T/d$$

$$T = d \tan\theta$$

The rotation and axial oscillation of the pistons 109 can be used advantageously for the transfer of fluid from a first location to a second location, and for the pressurization or depressurization of the fluid, by providing appropriate channels associated with the pistons and surrounding housing. Referring to FIG. 1, the piston cage 103 includes one or more inlet channels 112 which derive fluid from the main inlet channel 98 connected to a fluid source (not shown). The inlet channels 112 empty into channels 118 (FIGS. 1 and 3). The channels 118 may be located on a first plane "A," and extend outward in a spoke-like fashion from central inlet channel 112 to each of the pistons 109.

The piston cage 103 also includes a second set of spoke-like channels 119, located on a second plane "B". The planes A and B we spaced apart at a distance "T," which is the same as the axial travel distance of the pistons 109 during oscillation. The channels 119 extend from the surrounding pistons 109 to a centrally-located outlet channel 113.

As shown in FIGS. 1 and 2, each piston 109 includes a side-positioned slanted inlet channel 116, an opposite side-positioned slanted outlet channel 117, and a central channel 123 which communicates with the channels 116 and 117, and with the portion of the cavity 110 located at the spring-biased end of the piston. The channels 116 and 117 are positioned so that each channel 116 communicates with an inlet channel 118 when the associated piston 109 is nearly fully raised or extended, and each channel 117 communicates with an outlet channel 119 when the associated piston 109 is nearly fully lowered or depressed. This arrangement is best understood from FIG. 1, wherein the piston 109-1 is shown in the fully depressed position and the piston 109-4 is shown in the fully-extended position. As further shown in FIGS. 1 and 2, the slanting of the channels 116 and 117 is such that they also communicate with channels 118 and 119 when the corresponding piston is between its fully raised and fully lowered position. The position, width, length, and slant angle of slots 116 and 117 are precisely determined according to the design of piston cage 103. The spacing between inlet slot 116 and outlet slot 117 is the same as the distance between fluid passages 118 and 119 on piston cage 103.

Referring to FIG. 3, the pump 100 of this invention can have six pistons positioned evenly at 60° spacing around the center of piston cage 103. The number of pistons 109 is at least three, preferably at least five. The maximum is limited by the size of the pump and other practical considerations. The cavities 110 are sized to fit pistons 109 snugly but freely.

Plane A is where the fluid inlet passages 112 and 118 rout e low-pressure fluid from inlet 112 to cavities 110. Plane B is where the outlet fluid passes from the cavities 110 to passages 119 and 113. The distance "D" between. Plane A and Plane B on pump cage 103 is approximately the linear travel distance of pistons 109. The size or diameter of fluid passages 118 and 119 roughly correspond to the width of slots 116 and 117 on pump pistons 109.

As the pistons 109 rotate and oscillate up and down, inlet slot 116 and outlet slot 117 will alternately be exposed to fluid passages 118 and 119. Further, the direction of rotation of the c am 104 as well as that of pistons 109 will be consistent with the slope of the check valve slots 116 and 117. For example, when piston 109-1 is at its lowest position, its cavity 110-1 is about empty. It inlet slot 116-1 is about to engage inlet passage 118-1 and its outlet slot 117-1 is about to disengage outlet passage 119-1. A slight rotation of piston 109-1 in a counterclockwise rotation (viewed from the flat end of piston 109-1) will result in fluid flowing into cavity 110-1 through inlet passage 118-1 and inlet check valve slot 116-1. At the same time, the out let check valve slot 117-1 is blocked completely by the cavity wall.

As the cam disk 104 further rotates in a counterclockwise direction, piston 109-1 will continue to rotate in the sane direction and will rise. Cavity 110-1 gradually fills with the low-pressure fluid. Finally, after 180° rotation of cam disk 104, piston 109-1 will rise to its highest position represented by piston 109-4 in FIG. 1. Cavity 110-1 is filled completely. The inlet check valve slot 116-1 is about to lose connection to fluid passage 118-1 and the outlet check valve slot 117-1 is about to engage fluid outlet 119-1.

As soon as piston 109-1 passes its highest position, and cam disk 104 continues to rotate beyond 180°, piston 109-1 is forced to move downward, thus compressing the fluid inside cavity 110-1 and forcing it to flow out through passages 119-1 and 113, until the cam disk 104 completes its 360° rotation. As the piston 109-1 is going through its rotary oscillating motion, its cavity 110-1 is filled and then emptied (not completely). Other pump pistons go through exactly the same motion as cam disk 104 is rotated by the external torque applied to pump shaft 107.

The upward motion of pump pistons represents the charge stroke of pump 100 and the downward motion represents the power stroke of pump 100. The maximum pressure that pump 100 can attain is a function of the torque applied to shaft 107, the fit of pistons 109 inside cavities 110, and other design parameters. For even greater pressure capabilities, additional outlet check valves can be employed at each piston.

Pump 100 has the advantage of having built-in check valves of high pressure capabilities. There are multiple pistons so that the output pressure can be made to have little pulsations. The circular arrangement of pistons allows a very compact pump of high flow capability. Pump 100 is also self priming, allowing fluid to be sucked into pump cavities. By isolating the cam disk chamber 102 from the fluids, pump 100 can be used with all kinds of fluid, particularly liquids.

In another embodiment of this invention, the fluid transfer apparatus operates as a fluid powered motor for generating shaft torque with pressurized fluids such as hydraulic oil, water, and other liquids and gases. Because of the unique motion-conversion process of this invention, pump 100 shown in FIG. 1 and discussed earlier can be used as a motor by simply reversing the flow path of the fluid without any other changes. The reversal of the fluid flow will change the direction of cam disk rotation and the rotation of pistons. For best performance, however, the motor of this embodiment should be constructed differently from the floor used to drive the pump.

Figure 4:
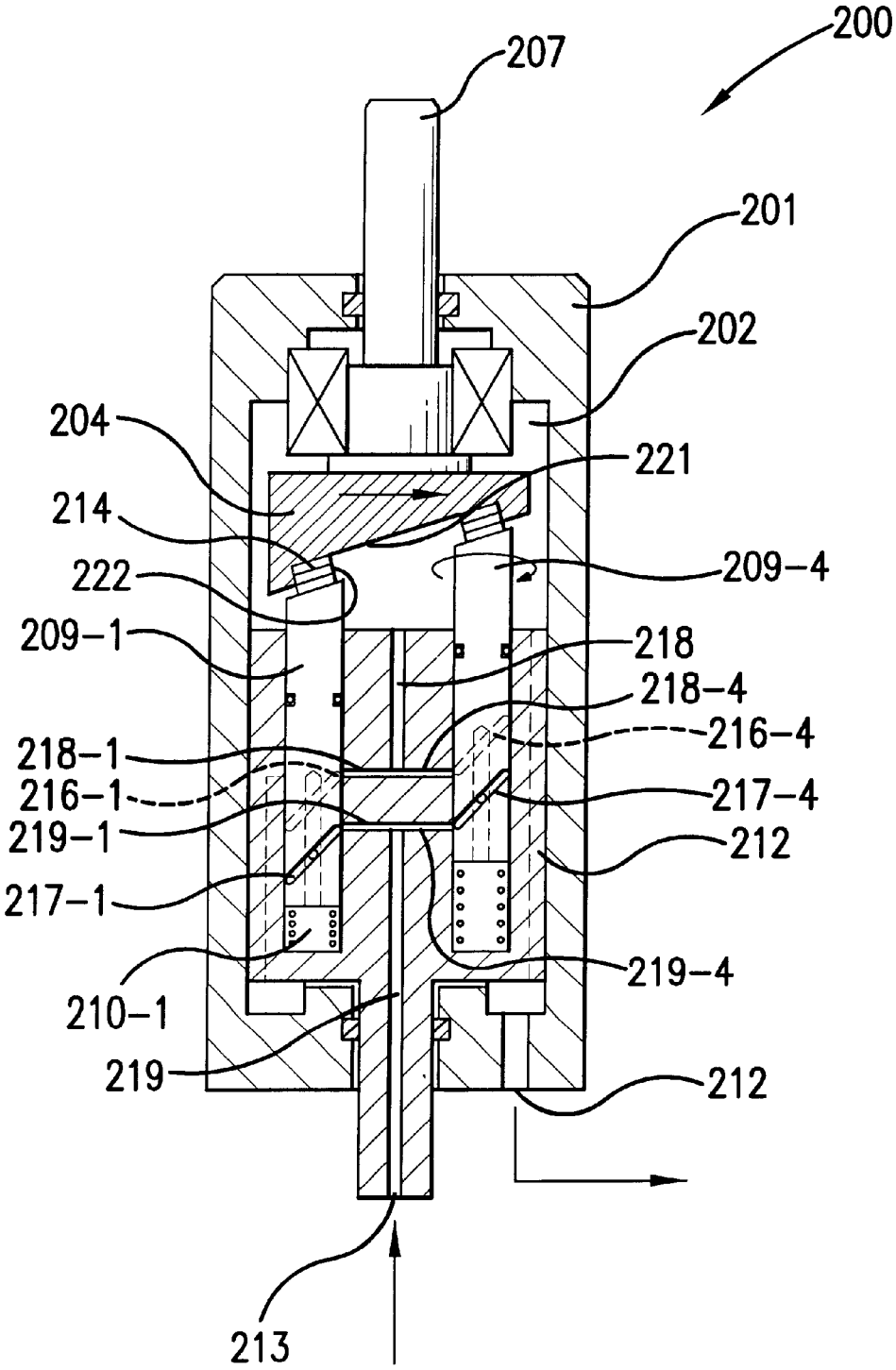
FIG. 4 is a sectional view of a second embodiment of the fluid transfer apparatus.

FIG. 4 illustrates a preferred construction when the invention is used as a fluid powered motor. Mot or 200 has a construction very similar to that of pump 100. If the motor is powered with hydraulic fluid, the pressurized fluid enters the motor housing 201 at in let 213. The fluid then flows through fluid passages 219 in piston cage 203, into the pistons 209 via inlet check valve slots 217, and into the spaces at the bottom of cavities 210. From cavities 210, the pressurized fluid pushes pistons 209 upward against cam disk 204 via the thrust bearings 214. The upward bias of pistons 209 against the slanted surfaces 221 and 222 of the cam disk 204 and pistons 209 generates a rotational force element which causes cam disk 204 to rotate clockwise when viewed from the fluid inlet end.

The pistons 209 also continue to rotate clockwise. As the rotating pistons move upward, pressurized fluid flows through the inlet slots 217 until a rotation of about 180° is reached from the lowest-point start. When a piston (e.g. 209-1) reaches is highest point at 180° rotation, inlet slot 217-1 of the piston loses its connection with fluid inlet 218-1, and an outlet slot 216-1 on the opposite side of piston 209-1 makes connection with outlet fluid passage 218-1 The spent fluid inside cavity 210-1 will then flow out of motor 200 at outlet 212 through passage 218, chamber 202, and passage 212.

In FIG. 4, piston 209-4 is at its highest position. Its outlet check valve slot 216-4 is about to be connected with outlet passage 218-4 while its inlet check valve slot 217-4 has lost connection to inlet fluid passage 219-4. Piston 209-4 is about to move down as the cam disk 204 continues to rotate in a clockwise direction, to start its exhaust stroke.

Motor 200 of this invention can have at least three pistons, preferably five or more, positioned at regular angles around the central axis of shaft 207. The maximum number of plungers is dictated by size and other practical considerations. In a six-piston, 60° spacing construction shown in FIG. 3, motor 200 will have at least two and at most three pistons under power from the pressurized fluid at any time, to push upward against the cam disk 204. This upward pushing force can be substantial if the fluid pressure is high and the plungers are of sufficient diameter. This upward pressure can generate significant tangential force causing rotation of the cam disk 204. The magnitude of tangential forces of pistons is dependent on the slant of the mating surface of cam disk 204 and the multiple pistons. The greater the slant angle θ, the greater will be the rotating power of motor shaft 207 connected to and driven by cam disk 204.

Motor 200 can be operated with just about any pressurized fluids. If fluids other than hydraulic fluids are used, chamber 202 must be filled with lubricating oil and isolated from the system fluid. When motor 200 is used with conventional hydraulic fluids, chamber 202 can be in the path of fluid flow.

Motor 200 of this invention has another noteworthy feature, namely braking power. When the supply of pressurized fluid is stopped, motor 200 will stop instantly and the motor shaft 207 will not be free to rotate. instead it will hold its position due to the fluid trapped inside the multiple motor cavities. This feature is very useful when motor 200 is used in wrenching applications.

Figure 5A:
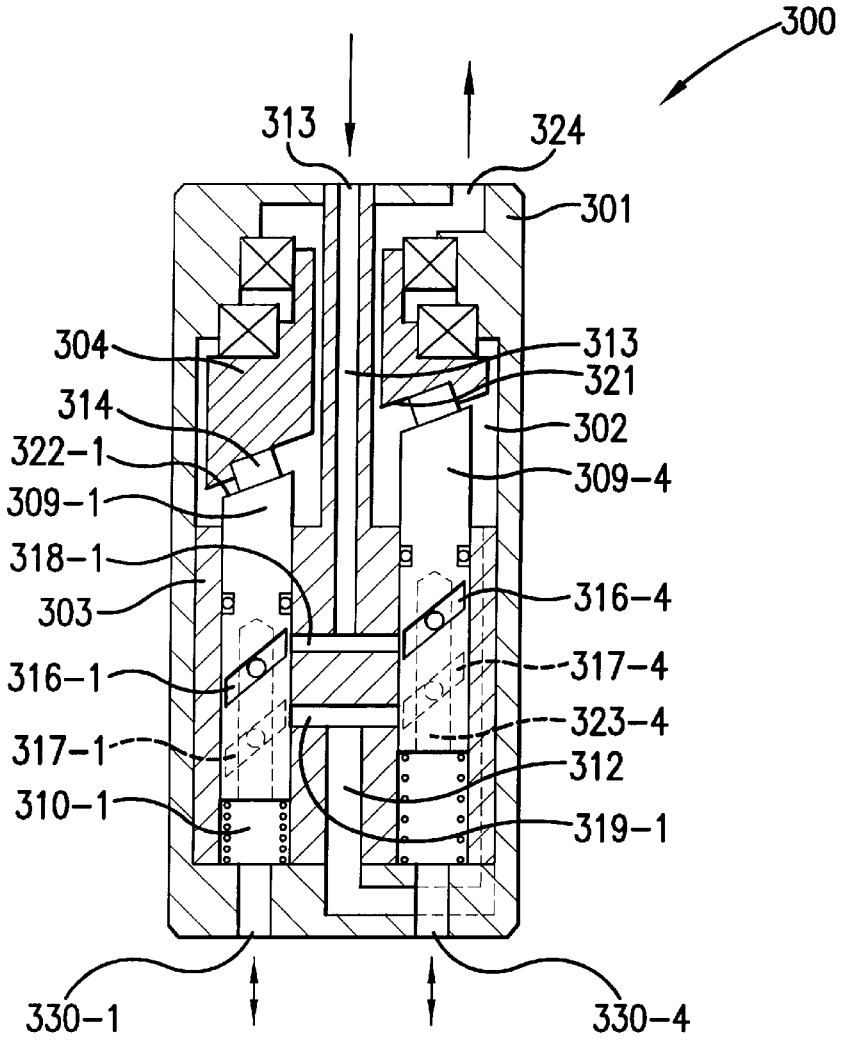
FIG. 5(*a*) is a sectional view of a third embodiment of the fluid transfer apparatus.
Figure 5B:
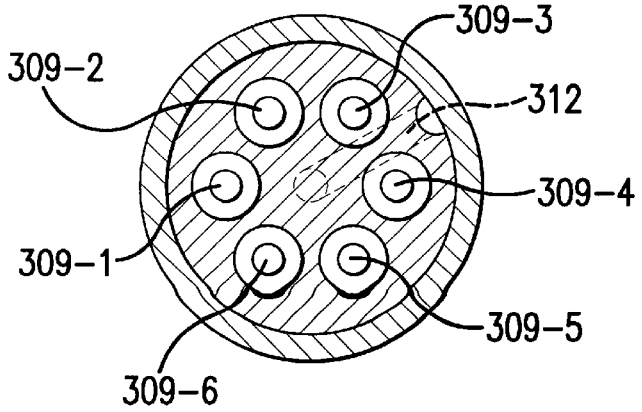

FIGS. 5(*a*) and 5(*b*) illustrate a preferred construction when the invention is used as a distribution valve. The illustrated valve 300 can route pressurized fluid from a single source to multiple ports and simultaneously route spent fluid from the multiple ports back to the source. Such valves are valuable in construction of multiple-cylinder fluid pressure intensifiers.

Referring to FIG. 5(*a*), which is a cross-sectional side view of a self-actuating fluid distribution valve of this invention, valve 300 is basically a motor similar to that shown in FIG. 4 except that pressurized system fluid is routed through the motor's multiple pistons to do work and the spent system fluid is simultaneously routed through the motor and returned to the source of the fluid. Pressurized system fluid enters housing 301 of valve 300 at inlet 313, and floors through inlet passage 313 of valve cage 303, which houses a minimum of three and preferably five or more valve pistons 309.

FIGS. 5(*a*) and 5(*b*) show a preferred valve having six valve pistons. Fluid supplied via inlet 313 is routed to six circularly arranged passages 318 and to six corresponding piston cavities 310 in which six valve pistons 309 are snugly situated. Valve pistons 309 each have a slanted upper surface 322 in contact with slanted surface 321 of cam disk 304, or cam disk thrust bearing 314. All six valve pistons are identical and have opposite situated check valve slots to serve as fluid passages to piston cavities. Inlet check valve slot 316 of each piston communicates to an inlet fluid passage 318 and outlet check valve slot 317 of each piston communicates to an outlet fluid passage 319 leading to a passage 312.

Once the pressurized fluid enters a piston cavity 310 through the inlet check valve slot 316 on the valve piston 309, it flows through the central cavity 323 and out of valve ports 330 to do work. For instance, the pressurized fluid can be used to drive a piston inside a fluid pressure intensifier (not shown). The spent fluid can then be returned to valve 300 via one or more ports 330, and routed through the corresponding valve pistons 309, outlet passages 319 and 312, chamber 302, and out of the valve's outlet 324.

In this process, a portion of the pressurized fluid's stored energy is spent pushing the valve piston 309 against cam disk 304 and causing it to rotate at a prescribed direction and speed. This rotating cam disk 304 in turn, produces a rotating oscillating motion in the valve pistons 309. Using this motion and the check valve slots on the valve pistons, the flow of fluid can be precisely controlled.

In the six-piston valve shown in FIG. 5, there are six ports that can be connected to six hydraulic cylinders of six intensifiers. When three of the ports are sending out pressurized fluid, the other three ports receive spent fluid. At a particular instant, valve pistons 309-1, 309-2 and 309-3 are pushing the cam disk 304 to generate the rotation while valve pistons 309-4, 309-5 and 309-6 are expelling the spent fluid out of the valve. As the cam disk 304 rotates, each valve piston rotates and oscillates in synch and the fluid flows through the valve in a two-way fashion. The operating speed of valve 300 is related to the flow rate of the fluid. When the flow rate is high, the valve will automatically increase the speed to accommodate the fluid flow.

Valve 300 can be made in different versions to meet the needs of various applications. The motor portion of the valve can be integrated with or separated from the valve portion. In all cases, a small portion of the energy stored in the pressurized fluid is employed to rotate the cam disk, which in turn regulates the motion of multiple valve pistons that control the fluid passages in an orderly fashion.

Figure 6:
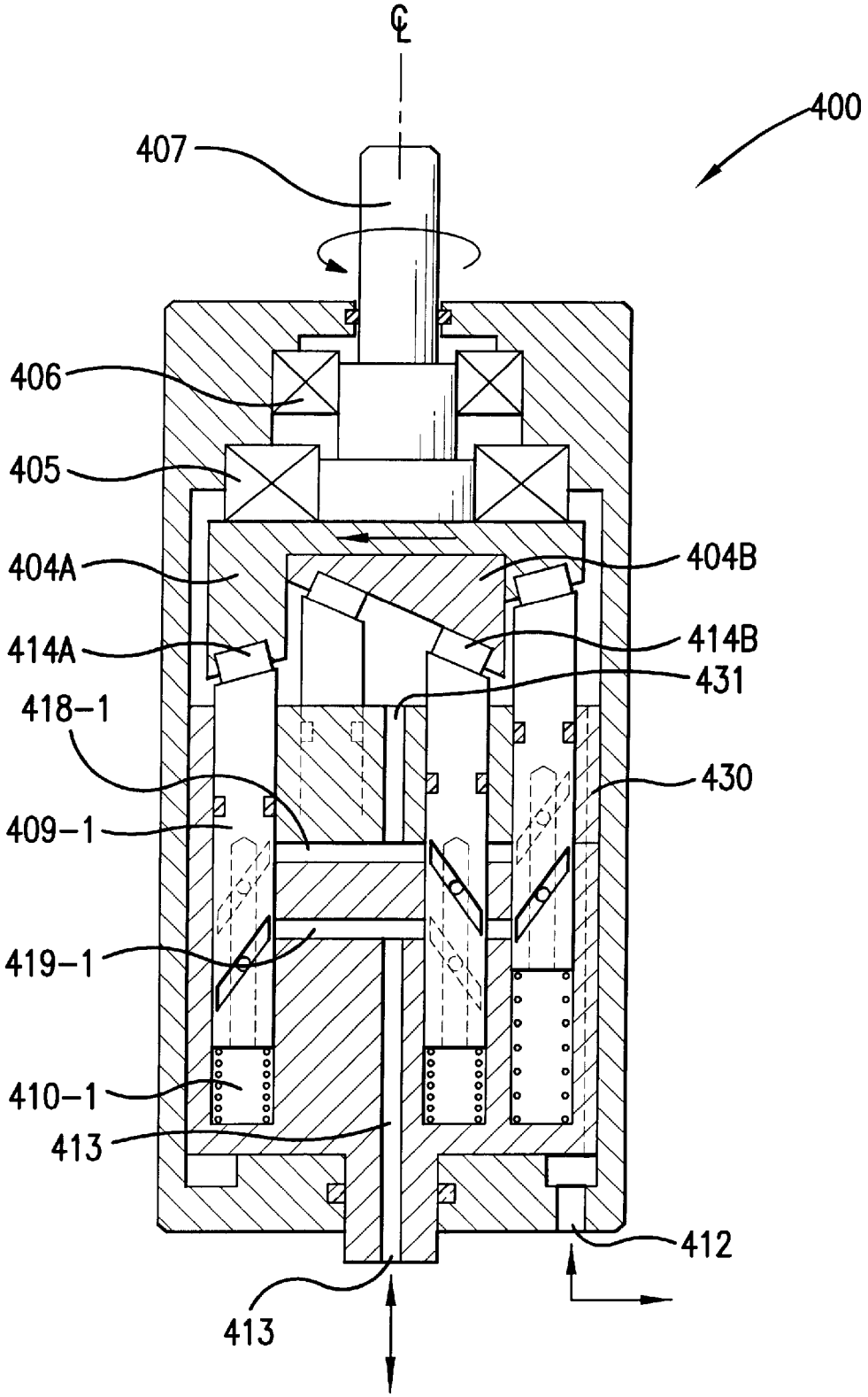
FIG. 6 is a sectional view of a fourth embodiment of the fluid transfer apparatus.
Figure 7:
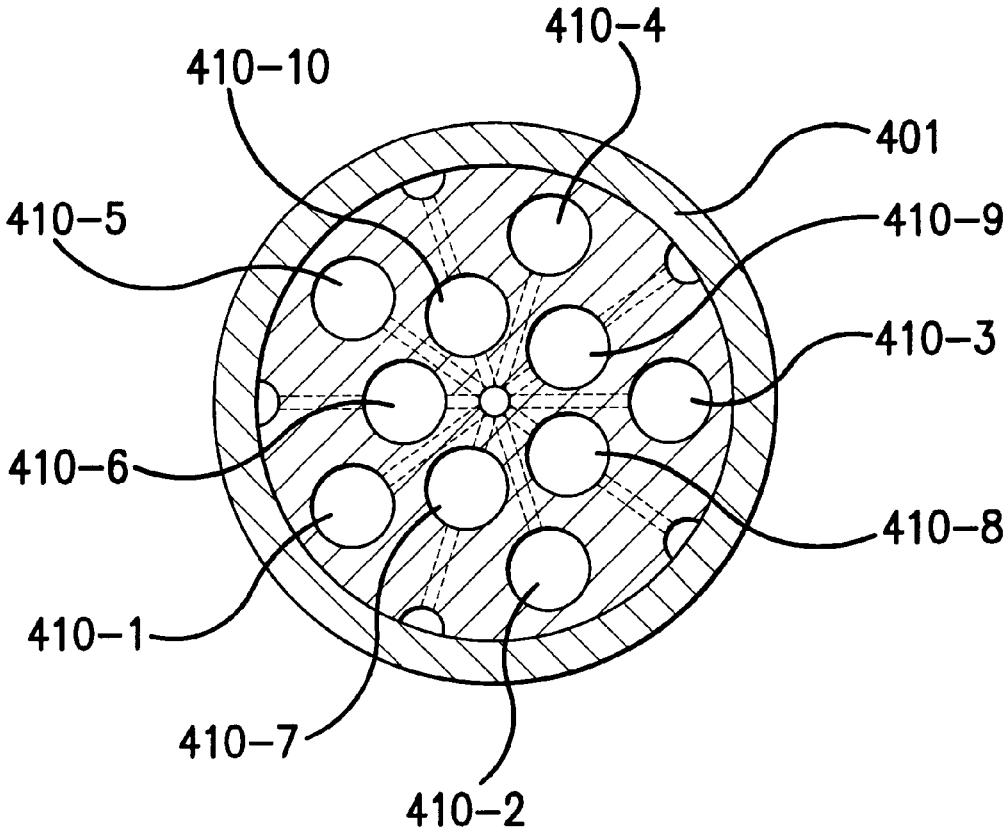
FIG. 7 is a schematic view showing the piston arrangement in the device of FIG. 6.

FIGS. 6 and 7 illustrate a preferred construction when the invention is used as a multiple-piston pump or motor that employs compound cam disks to better distribute the load and utilize the space. Referring to FIG. 6, a pump/motor 400 of this invention involves the use of two concentrically-placed, sloped-face cam disks mounted together in a manner that their sloped face are crossed (having opposing angles) when viewed from the side. There is a larger outer cam disk 404A and a smaller inner cam disk 404B. Both are supported by thrust bearing 405 and radial bearing 406 and are associated with a common shaft 407.

The basic construction of pump/motor 400 is similar to that shown in FIG. 1 and FIG. 4, except that there are more pistons. A minimum of six pistons are employed in pump/motor 400. Three of the pistons 409 communicate with cam disk 404A via thrust bearings 414A, and three with cam disk 404B via thrust bearings 414B. The two sets of three pistons are preferably arranged in concentric circles, at 120° spacing between pistons around the centerline of shaft 407. If more pistons are used in a set, the spacing angle will be smaller but should be even.

The preferred number of pistons for use in pump/motor 400 is at least ten, five of which are associated with inner cam disk 404B and five with outer cam disk 404A. Both sets of pistons are spaced evenly around the shaft 407 centerline. Thrust bearings 414A and 414B should be placed between the cam disks and the multiple pistons to minimize wear. With this arrangement, the load imposed on the cam disks is more uniformly distributed. As a result, shaft 407 is less likely to wobble during rotation. The ability to place many pistons within a small area allows the construction of very slim hydraulic pumps and motors of high capabilities.

When the embodiment 400 is used as a hydraulic pump or pump for other fluids, torque is applied to shaft 407 with a prime mover such as a motor (not shown). System fluid is introduced into the pump at low-pressure port 412 and flows through passages 430 and 431. From the central passage 431, the fluid flows to radial fluid passages 418 and eventually to cavities 410-1 through 410-10, in a ten-piston unit, in a controlled manner dictated by the exact position of the ten pistons 409-1 through 409-10 (FIG. 7).

As the cam disks 404A and 404B rotate in a counter-clockwise rotation, for instance, the fluid inside some piston cavities 410 will be compressed by the pistons 409 and flow out by following flow passages 419 and outlet passage 413. During each cycle of rotation of the cam disks, each piston fill complete a suction stroke and a power stroke. In a 5—5 piston arrangement, as shown in FIG. 7, there will be a minimum of two or maximum of three outer pistons on power stroke (compressing the fluid) during each rotation circle. The same is true for the inner five pistons. Further, the outer pistons on power stroke will be opposite to those inner pistons that are on power stroke. Thus, the load on the thrust and radial bearings is better balanced as compared to the single-cam disk arrangement shown in FIG. 1 and FIG. 4. This feature is particularly important in large, high-power pumps and motors.

When the pump/motor 400 of this invention is used as a fluid powered motor, the path of fluid will be reversed, which results in change of rotation direction of cam disks and plungers. Torque is then generated at shaft 407 and is available to do work.

EXAMPLE

A pump/motor unit according to this invention was constructed according to the design shown in FIG. 1 through FIG. 3. The unit had an overall length of 7.2 inches and diameter of 1.750 inches, and was made of stainless steel throughout. It included a pump case 4.5 inches in length and 1.5 inches in outside diameter, an end cap 1.8 inches in length and 1.750 inches in diameter, and a pump cage 2.400 inches in length and 1.250 inches in diameter having five circularly positioned axial cavities 0.313 inches in diameter spaced at 72° apart. Five pistons were positioned in the cavities. Each piston was 1.850 inches, in length and 0.312 inches in diameter, and had a 22° sloped face on one end and two opposite-placed 0.09 inch wide check valve slots on the other end slanted at 45° to the axis.

The pump also included a cam disk of 1.100 inches in diameter having a 0.375 inch diameter shaft connected on one end and a 22° sloped face, a 1.125 inch diameter thrust bearing, a 1.000 inch diameter radial bearing, and an end plug having a central fluid passage to serve high-pressure fluid. The low-pressure fluid port was situated on the side of the end cap. Static O-ring seals were located at strategic points to seal off the fluid. O-ring seals on the five pistons isolated the system fluid from the lubricating oil present in cam disk chambers. Five small springs in the plunger cavities biased the pistons. Fluid passages were made in the pump cage according to that shown in FIGS. 1 through 4.

A thin thrust bearing of about 1.125 inches in diameter was situated between the cam disk and the five pistons. The unit was assembled by placing the bearings and cam disk into the case first, followed by the piston cage with pistons, the end plug, and the end cap. The end cap was threaded to the case to keep the interior fluid tight.

When hydraulic oil was introduced into the central high-pressure port, the shaft started to rotate in a clockwise direction when viewed from the side and having the shaft on top. The speed of shaft rotation increased with the increase in fluid pressure, and the shaft exhibited high torque. It operated as a versatile motor. Shaft rotation was produced with pressurized oil as well as pressurized water.

When a small electric motor of 1/10-hp power capability was attached to the shaft through a flexible joint, and hydraulic oil from a reservoir was routed to the side low-pressure port of the pump, oil flowed out of the central port at a much higher pressure. The output pressure was quite steady, indicating the benefit of having five plungers. It was estimated that this pump has a maximum pressure capability of 10,000 psi if adequate input power is provided. This pump can also be used with water owing to its all stainless steel construction. It is, however, not suitable for use as an air compressor due to its inadequate inlet passage for gases. The pump/motor of this example operated effectively both as a pump and a motor without changing any parts.

While the embodiments of the invention disclosed herein are presently preferred, various modifications and improvements can be made without departing from the spirit and scope of the invention. The scope of the invention is indicated by the appended claims, and all changes that fall within the meaning and range of equivalents are intended to be embraced therein.

I claim:

1. A fluid transfer apparatus, comprising:

a torque transmitter;

a rotary device associated with the torque transmitter;

three or more pistons arranged substantially in a circle;

a piston housing permitting axial and rotational movement of the pistons;

an oscillator associated with the rotary device causing axial oscillation and rotation of the pistons during rotation of the rotary device; and channels associated with the pistons and piston housing for effecting the transfer of fluid from a first location to a second location as the pistons oscillate.

2. The fluid transfer apparatus of claim 1, wherein the torque transmitter comprises a rotatable shaft communicating with the rotary device.

3. The fluid transfer apparatus of claim 1, wherein the rotary device comprises a rotatable cam disk.

4. The fluid transfer apparatus of claim 1, wherein the rotary device comprises the oscillator.

5. The fluid transfer apparatus of claim 4, wherein the oscillator comprises a slanted surface on the rotary device communicating with the pistons.

6. The fluid transfer apparatus of claim 1, wherein the channels comprise inlet and outlet channels in each piston, and a central channel in each piston communicating with the inlet and outlet channels.

7. The fluid transfer apparatus of claim 6, further comprising cavities in the piston housing, in communication with the central channels, for effecting compression or decompression of fluid during axial movement of the pistons.

8. The fluid transfer apparatus of claim 6, wherein the channels further comprise fluid inlet channels on a first plane in the piston housing and outlet channels on a second plane in the piston housing, positioned so the inlet and outlet channels in the piston housing communicate with the inlet and outlet channels in the pistons during movement of the pistons.

9. The fluid transfer apparatus of claim 6, wherein the inlet and outlet channels in each piston are slanted.

10. The fluid transfer apparatus of claim 1, comprising five or more of the pistons arranged substantially in a circle.

11. A pump for pressurizing and transferring fluid, comprising:

a rotatable cam having a first side, and a slanted second side;

a motor-driven shaft in communication with the first side of the cam;

a piston housing including three or more piston cavities arranged substantially in a circle;

three or more pistons capable of axial rotational movement, each having a first end in communication with the slanted second side of the rotatable cam, and a second end in a piston cavity; and inlet and outlet channels in the piston housing and pistons for effecting the transfer and pressurization of fluid during movement of the pistons.

12. The pump of claim 11, wherein the second side of the rotatable cam is slanted at an angle, and the first end of each piston is slanted at a complementary angle.

13. The pump of claim 11, wherein inlet and outlet channels in the pistons are formed in outer surfaces of the pistons, and engage the inlet and outlet channels in the piston housing during movement of the pistons.

14. The pump of claim 13, wherein the inlet and outlet channels in the pistons are slanted.

15. The pump of claim 11, comprising five or more of the piston cavities arranged substantially in a circle, and five or more oil the pistons.

16. A fluid-powered motor, comprising:

a rotatable cam having a first side, and a slanted second side;

a drive shaft in communication with the first side of the cam;

a piston housing including three or more piston cavities arranged substantially in a circle;

three or more pistons capable of axial and rotational movement, each having a first end in communication with the slanted second side of the rotatable cam, and a second end in a piston cavity; and inlet and outlet channels in the piston housing ad pistons for effecting the transfer of pressurized fluid to sequentially oscillate the pistons, causing rotation of the cam and drive shaft.

17. The motor of claim 16, wherein the second side of the rotatable cam is slanted at an angle, and the first end of each piston is slanted at a complementary angle.

18. The motor of claim 16, wherein inlet and outlet channels in the pistons are formed in outer surfaces of the pistons, and engage the inlet and outlet channels in the piston housing during movement of the pistons.

19. The motor of claim 18, wherein the inlet and outlet channels in the pistons are slanted.

20. The motor of claim 16, comprising five or more of the piston cavities arranged substantially in a circle, and five or more of the pistons.

21. A fluid distribution valve, comprising:

a rotatable cam having a first side, and a slanted second side;

a piston housing including three or more piston cavities arranged substantially in a circle;

three or more pistons capable of axial and rotational movement, each having a first end in communication with the slanted second side of the rotatable cam, and a second end in a piston cavity;

inlet channels in the piston housing;

inlet channels in the pistons communicating with the inlet channels in the piston housing during movement of the piston, and with the piston cavities;

distribution channels in the piston cavities communicating with the exterior of the piston housing;

outlet channels in the piston housing; and outlet channels in the pistons communicating with the piston cavities, and with the outlet channels in the piston housing.

22. The valve of claim 21, wherein the second side of the rotatable cam is slanted at an angle, and the first end of each piston is slanted at a complementary angle.

23. The valve of claim 21, wherein the inlet and outlet channels in the pistons are formed in outer surfaces of the pistons.

24. The valve of claim 23, wherein the inlet and outlet channels in the pistons are slanted.

25. The valve of claim 21, comprising five or more of the piston cavities arranged substantially in a circle, and five or more of the pistons.

* * * * *